US008747085B2

(12) United States Patent
Schmidt et al.

(10) Patent No.: US 8,747,085 B2
(45) Date of Patent: Jun. 10, 2014

(54) SLIDING VANE PUMP WITH IMPROVED ROTOR PROFILE

(75) Inventors: Eugen Schmidt, Merbelsrod/Thueringen (DE); Andreas Schmidt, legal representative, Schwarzbach (DE); Franz Pawellek, Lautertal (DE); Andreas Blechschmidt, Zella-Mehlis (DE); Nico Eberhardt, Herschdorf/OT Willmersdorf (DE); Torsten Wilhelm, Auengrund/OT Merbelsrod (DE)

(73) Assignee: Geraete- und Pumpenbau GmbH Dr. Eugen Schmidt, Merbelsrod/Thueringen (DE)

( * ) Notice: Subject to any disclaimer, the term of this patent is extended or adjusted under 35 U.S.C. 154(b) by 623 days.

(21) Appl. No.: 12/998,760

(22) PCT Filed: Nov. 23, 2009

(86) PCT No.: PCT/DE2009/001667

§ 371 (c)(1),
(2), (4) Date: May 27, 2011

(87) PCT Pub. No.: WO2010/060416

PCT Pub. Date: Jun. 3, 2010

(65) Prior Publication Data

US 2011/0293458 A1 Dec. 1, 2011

(30) Foreign Application Priority Data

Nov. 29, 2008 (DE) ..... 10 2008 059 720

(51) Int. Cl.
*F04C 2/344* (2006.01)
*F04C 15/06* (2006.01)

(52) U.S. Cl.
CPC ..... *F04C 15/06* (2013.01); *F04C 2240/20* (2013.01); *F04C 2250/20* (2013.01); *F04C 2270/12* (2013.01); *F04C 2270/13* (2013.01); *F04C 2/3441* (2013.01)
USPC ..... 418/29; 418/30

(58) Field of Classification Search
USPC ..... 418/29, 30, 260
See application file for complete search history.

(56) References Cited

U.S. PATENT DOCUMENTS 4,531,893 A 7/1985 Okoh et al.
5,490,770 A 2/1996 Oogushi (Continued)

FOREIGN PATENT DOCUMENTS

DE 29 14 282 10/1980
DE 33 34 919 3/1984

(Continued)

OTHER PUBLICATIONS

International Search Report of PCT/DE2009/001667, Sep. 29, 2010.

*Primary Examiner* — Mary A Davis
(74) *Attorney, Agent, or Firm* — Collar & Roe, P.C.

(57) ABSTRACT

A vane cell pump has a rotor mounted in a pump housing and driven by a shaft, multiple vane plates mounted in the outer circumference of this rotor, and an outer ring that surrounds the rotor and the vane plates, whereby this ring is disposed either directly in the pump housing, or in a setting ring that can be moved in the pump housing, along predetermined paths. The vane cell pump has transverse grooves disposed in the cylinder mantle surface of the rotor, between the bearing grooves of the vane plates, running over the entire rotor width, disposed parallel to the bearing grooves of the vane plates, spaced apart from the bearing grooves by a bearing cross-piece. These transverse grooves have a non-symmetrical cross-section progression, which has a low point in each cell chamber, which point is always disposed behind the cell chamber center axis, seen in the direction of rotation.

10 Claims, 2 Drawing Sheets

(56) References Cited

U.S. PATENT DOCUMENTS

Figure 1:
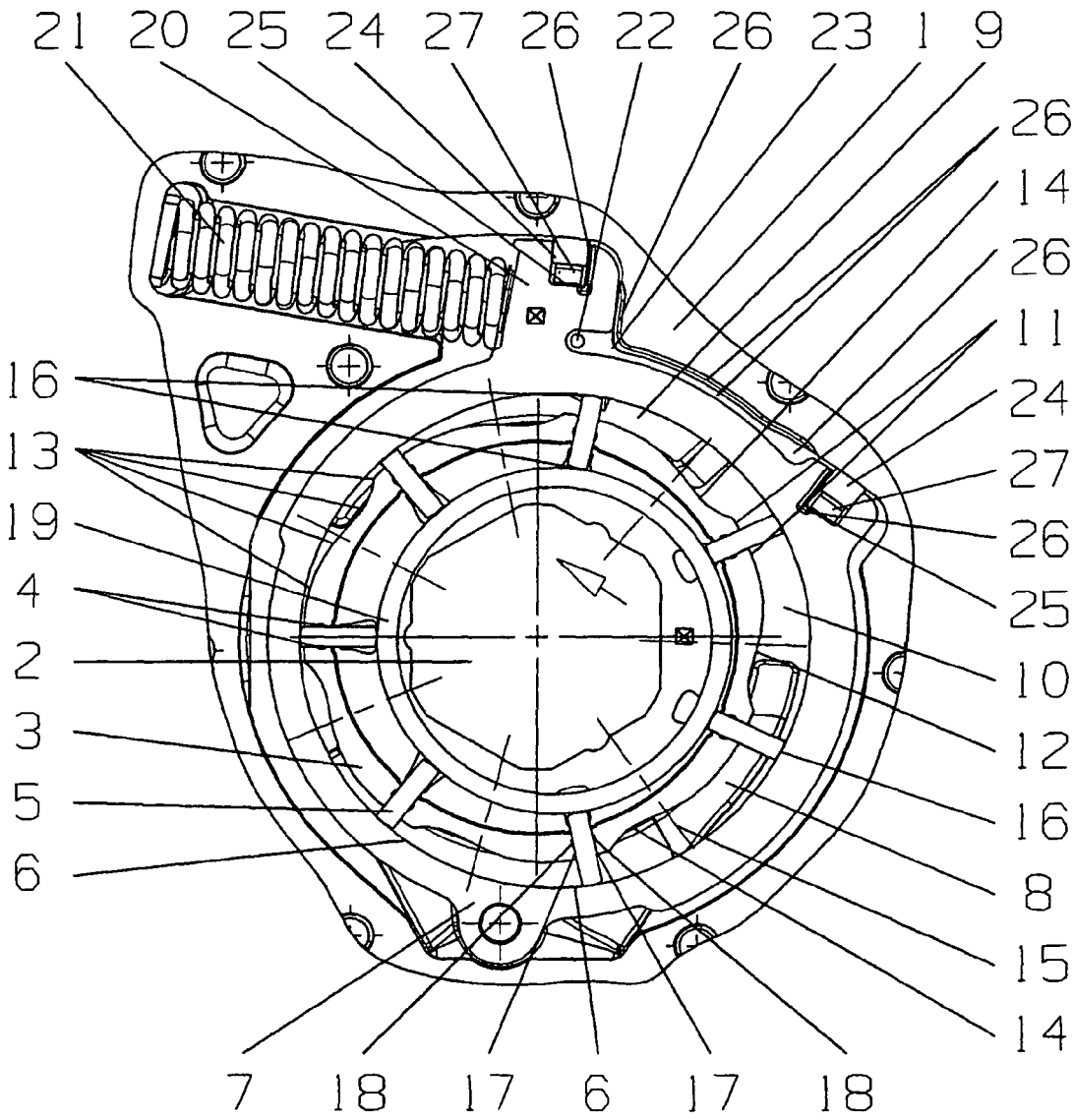

| | | | | |
|---|---|---|---|---|
| 6,237,560 | B1 * | 5/2001 | Saito | 123/243 |
| 6,857,862 | B2 | 2/2005 | Johnson et al. | |
| 8,382,461 | B2 * | 2/2013 | Hedrich | 418/30 |
| 2007/0280842 | A1 * | 12/2007 | Ueki et al. | 418/30 |
| 2009/0269234 | A1 | 10/2009 | Hedrich, Jr. | |

FOREIGN PATENT DOCUMENTS

| | | |
|---|---|---|
| DE | 44 42 083 | 6/1995 |
| DE | 195 33 686 | 3/1997 |
| DE | 10 2004 019 326 | 11/2004 |
| DE | 103 53 027 | 6/2005 |
| DE | 602 07 401 | 8/2006 |
| DE | 10 2006 061 326 | 7/2008 |
| DE | 10 2008 006 289 | 7/2009 |
| EP | 1 384 005 | 11/2005 |
| GB | 2 305 218 | 4/1997 |
| JP | 2004-204798 | 7/2004 |
| WO | WO 2005/003562 | 1/2005 |

* cited by examiner

SLIDING VANE PUMP WITH IMPROVED ROTOR PROFILE

CROSS REFERENCE TO RELATED APPLICATIONS

This application is the National Stage of PCT/DE2009/001667 filed on Nov. 23, 2009, which claims priority under 35 U.S.C. §119 of German Application No. 10 2008 059 720.1 filed on Nov. 29, 2008, the disclosure of which is incorporated by reference. The international application under PCT article 21 (2) was not published in English.

The invention relates to vane cell pumps having a rotor mounted in a pump housing and driven by a shaft, multiple vane plates mounted in the outer circumference of this rotor, and an outer ring that surrounds the rotor and the vane plates, whereby this ring is disposed either directly in the pump housing, or in a setting ring that can be moved in the pump housing, along predetermined paths.

In the state of the art, very different embodiments of vane cell pumps have been previously described. For example, DE 29 14 282 C2 and DE 103 53 027 A1 describe vane cell pumps that can be regulated, in each instance, having a setting ring that can be displaced in linear manner, to achieve a variable output power.

In DE 195 33 686 C2, a different design of a vane cell pump that can be regulated is previously described; it has a setting ring mounted to pivot about a bolt.

In most cases, on both sides of the rotor of a vane cell pump, a suction kidney is disposed, on the one hand, and a pressure kidney is disposed offset by 180° relative to it, on the other hand.

All the aforementioned designs have in common that the inner ring between the mounting locations of the separation elements is always configured in arc shape, i.e. as an arc corresponding to the outside diameter of the inner ring, in each instance.

In other patents/patent applications, such as, for example, in DE 33 34 919 C2, DE 44 42 083 A1, or also in DE 602 07 401 T2, designs of vane cell pumps with variable output power are previously described, in which transverse grooves are disposed on/in the lower edge of each cell chamber, i.e. in the "cylinder mantle surface" of the rotor, in each instance, which grooves run over the entire rotor width, parallel to the bearing grooves of the vane plates, at the lower edge of each cell chamber, are spaced apart from the bearing grooves, are always configured symmetrical to the center axis of each cell chamber, trough-shaped in cross-section and in almost all cases, are shaped in trapezoid shape; these grooves are often supposed to increase the volume of the pump cell chambers, in each instance, to the maximum that is possible for the design in question.

In a different patent application, such as in DE 10 2004 019 326 A1, for example, different cell pumps, such as roller cell pumps, for example, are previously described, in which transverse grooves are disposed on/in the lower edge of each cell chamber, i.e. again in the "cylinder mantle surface" of the rotor, which grooves are configured to be symmetrical to the center axis of each cell chamber, run over the entire rotor width, parallel to the bearings of the cylinder rollers, at the lower edge of each cell chamber, and are almost rectangular, formed in trough shape, in cross-section; these grooves also clearly increase the volume of the pump chamber, in each instance, and are actually supposed to double it in the design presented here.

A further cell pump is presented in DE 10 2006 061 326 A1. This is a pendulum valve machine that can be regulated in terms of amount, in which, in FIG. 1, transverse grooves are disposed on/in the lower edge of each cell chamber, i.e. in the "cylinder mantle surface" of the inner rotor, and simultaneously also in the "cylinder mantle surface" of the outer rotor, which grooves also run over the entire rotor width, are also configured symmetrical to the center axis of each cell chamber, and are shaped in semicircular shape, in their cross-section, in the "cylinder mantle surface" of the inner rotor, and in almost trapezoid shape, in trough shape, in their cross-section, in the "cylinder mantle surface" of the outer rotor; in this design, as well, these grooves are supposed to increase the volume of the pump cell chamber, in each instance, to a maximum, if at all possible, in this design of a very special vane cell pump.

As the state of the art that has been described shows, pump designers have been attempting for decades, and are currently still attempting, to make available the greatest possible inflow cross-sections for best possible filling of the displacer cells, by means of "clearances" disposed in the rotor walls of the most varied vane cell pump designs, which are configured symmetrical to the center axis of the cell chambers, in each instance.

In accordance with the eccentricity of the rotor relative to the outer ring, in each instance, the pump design, in each instance, then pumps the conveyed volume stream from the suction kidney into the pressure kidney, by means of these solutions.

However, a significant disadvantage of the aforementioned designs of vane cell pumps of the present state of the art consists, up to the present day, in that high power losses, noise development that increases greatly with an increasing speed of rotation, and wear that also increases greatly with an increasing speed of rotation, occur at speed of drive rotation in the range of 4500 rpm to beyond 6000 rpm (i.e. when using these vane cell pumps as oil pumps directly driven by the crankshaft of a motor vehicle engine).

The task of the invention now consists in developing vane cell pumps that avoid the aforementioned disadvantages of the state of the art and clearly reduce not only the power losses but also the noise development and the wear, as compared with the pump designs prescribed in the state of the art, particularly in a speed of rotation range from 4500 rpm to beyond 6000 rpm, but nevertheless are easy to manufacture, in terms of production technology, and which are further characterized by great reliability, a long useful lifetime, a high specific conveyed volume stream, and great efficiency, in all ranges of the speed of rotation.

According to the invention, this task is accomplished by means of a vane cell pump having a rotor (3) mounted in a pump housing (1) and driven by a shaft (2), multiple vane plates (5) mounted in bearing grooves (4) of the rotor (3), and an outer ring (6) that surrounds the rotor (3) and the vane plates (5), having a suction kidney (8) disposed in the pump housing (1), and a pressure kidney (9) disposed in the pump housing (1) offset by 180° from the former, having transverse grooves (12) disposed at the lower edge of each cell chamber (10), i.e. in the cylinder mantle surface of the rotor (3), between the bearing grooves (4), running over the entire rotor width, disposed parallel to the bearing grooves (4) of the vane plates (5), spaced apart from the bearing grooves (4) by a bearing crosspiece (11), which grooves are characterized, according to the invention, in that these transverse grooves (12) have a non-symmetrical cross-section progression (13), which has a low point (14) in each cell chamber (10), which point is always disposed behind the cell chamber center axis (15), seen in the direction of rotation.

By means of this non-symmetrical configuration of the cross-section progression (13) of the transverse groove (12) in vane cell pumps, the power losses, the noise development, and the wear were surprisingly clearly reduced as compared with the pump designs previously described in the state of the art, in the speed of rotation range from 4500 rpm to beyond 6000 rpm.

In this connection, the solution according to the invention can be manufactured in simple manner, in terms of production technology, and is characterized, in all speed of rotation ranges, by great reliability, a long useful lifetime, a high specific conveyed volume stream, and furthermore also by great efficiency.

In series of experiments, it was found that the cell chambers of the vane cell pumps of the state of the art as described, having a symmetrically greatly "enlarged" cell geometry, are no longer "completely" filled during the "suction phase", particularly in the speed of rotation range from 4500 rpm to above 6000 rpm.

As a consequence of this "incomplete" filling of the cell chambers, cavitation phenomena occur in the vane cell pumps previously described in the state of the art, with symmetrically enlarged cell chambers, which phenomena are a cause of the noise development that occurs in the speed of rotation range from 4500 rpm to beyond 6000 rpm, the wear that occurs in this speed of rotation range, but also for the power losses that occur in this speed of rotation range.

Surprisingly, in contrast, in the series of experiments conducted with the new type of cell chamber geometry, according to the solution according to the invention, optimal, complete, cavitation-free filling of the cell chambers (10) according to the invention was always achieved, without problems, even at speeds of rotation in the range of 4500 rpm to above and beyond 6000 rpm.

The novel transverse grooves (12) according to the invention, which have a non-symmetrical cross-section progression (13), and have a low point (14) in each cell chamber (10), which point always lies behind the cell chamber center axis (15), seen in the direction of rotation, furthermore guarantee low-friction and optimal, complete filling, in terms of flow technology, of the pump chambers, as the result of their optimal, very special flow technology configuration.

It should also be emphasized that aside from complete and optimal filling of the cell chambers (10), by means of the solution according to the invention, even at the speeds of rotation that were very critical until now, in the range of 4500 rpm to beyond 6000 rpm, at the same time, very optimal and fast, low-friction emptying of the cell chambers (10) is guaranteed, as compared with the previous state of the art.

It is furthermore very advantageous in this connection that the transverse grooves (12) according to the invention can also be produced in very simple manner, in terms of production technology.

In the series of experiments conducted with the solution according to the invention, it was found that surprising effects also occur by means of the asymmetrical pump cell cross-section according to the invention, which effects are presumably brought about in connection with the reflection of the fluid that flows into the cell chambers at the vane plates.

All of these surprising effects brought about by the solution according to the invention guarantee complete filling of the pump chambers also beyond 5000 rpm, as well as their optimal emptying, and, in this connection, at the same time clearly reduce the power losses and the wear of vane cell pumps.

Particularly advantageous embodiments, details, and further characteristics of the invention are evident from the dependent claims and the following description of an exemplary embodiment according to the invention, in connection with two drawings concerning the solution according to the invention.

The invention will now be explained in greater detail using an exemplary embodiment in connection with two figures.

Figure 2:
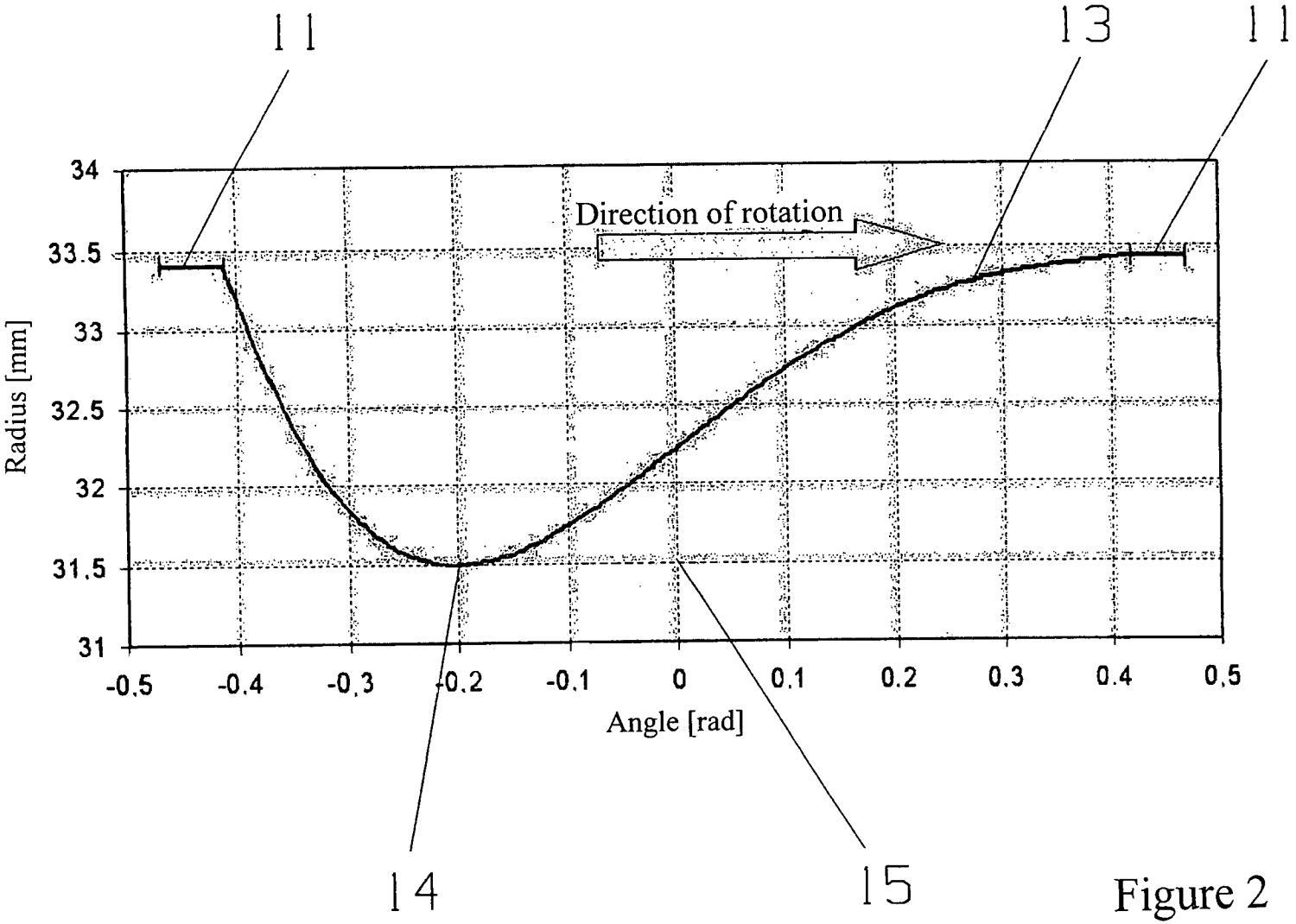

These show:

FIG. 1: the vane cell pump according to the invention, in a side view (without the lateral cover);

FIG. 2: the representation of the cross-section progression 13 of the transverse groove 12 according to the invention, according to FIG. 1 (in polar coordinates).

In FIG. 1, the vane cell pump according to the invention is shown in a side view, without a cover, with a rotor 3 mounted in a pump housing 1 and driven by a shaft 2, in this exemplary embodiment driven directly by the crankshaft, with multiple vane plates 5 mounted in bearing grooves 4 of the rotor 3, in radially displaceable manner, and an outer ring 6 that surrounds the rotor 3 and the vane plates 5.

In this exemplary embodiment, this outer ring 6 is disposed in a setting valve 7 that is mounted so as to rotate and provided with a setting lever 20.

A pressure spring 21 mounted in the pump housing 1 lies against the setting lever 20 on one side.

A control pressure chamber 23 to which the control pressure of the gallery is applied by way of an in-flow opening 22 is disposed on the opposite side of the setting lever 20.

Furthermore, a suction kidney 8 and a pressure kidney 9 disposed offset by 180° from the former are situated in the pump housing 1.

Transverse grooves 12 are disposed at the lower edge of each cell chamber 10 of the rotor 3, between the bearing grooves 4 of the vane plates 5, running over the entire width, i.e. along the mantle surface of the rotor 3, disposed parallel to the bearing grooves 4 of the vane plates 5, spaced apart from the bearing grooves 4 by a bearing crosspiece 11.

According to the invention, these transverse grooves 12 have a non-symmetrical cross-section progression 13, which has a low point 14 in each of the cell chambers 10, which point is always disposed behind the cell chamber center axis 15, seen in the direction of rotation, whereby this low point 14 lies below this imaginary outside diameter of the rotor 3, which notionally connects the bearing crosspieces 11 with one another, by about 1% to 8% of the outside diameter of the rotor 3.

It is furthermore characteristic that the non-symmetrical cross-section progression 13 of the transverse grooves 12 on the rotor 3, as shown in this exemplary embodiment, can also be described by a fourth-degree polynomial.

According to the invention, the polynomial on which this exemplary embodiment is based is defined in the range of approximately −0.42 rad to +0.42 rad, and reads: $y=39.33695\,x^4-31.29170\,x^3+0.4913634\,x^2+5.285977\,x+32.22082$.

This function progression, as one of the possible cross-section progressions 13 of the transverse groove 12 according to the invention, is shown in FIG. 2, within the aforementioned limits.

The transverse grooves 12 of the cell chambers 10 that are shown in FIG. 1 also always have this cross-section progression 13 as shown in FIG. 2.

In the case of the seven-vane vane cell pump shown in FIG. 1, the width of a segment (including the related vane plate sections) amounts to 51.4285°.

If one considers the rotor mantle in a cell chamber 10, this at first follows the "original" outside rotor diameter, directly next to the bearing grooves 4 that delimit the cell chamber 10 on both sides, i.e. in the region of the bearing crosspieces 11

(in this exemplary embodiment, on both sides, over a "width region" of the cell chamber 10 of about 5%).

The bearing crosspieces 11 that are formed in this connection and are disposed directly next to the bearing grooves 4 of the vane plates 5, guarantee the required transfer of force and the rigidity of the rotor 3 even at great stress on the vane cell pump.

Seen in the direction of rotation, the "first" bearing crosspiece 11 of the cell chamber 10 being considered is then followed by a second region, over approximately 63% of the width of the cell chamber 10 along the imaginary "original" outside rotor diameter, in which region the cross-section progression 13 of the transverse groove 12 drops all the way to a low point 14, in this exemplary embodiment to the radius 31.5 mm, i.e. by 1.9 mm (2.85% of the original outside rotor diameter of 66.8 mm).

This second sector is followed, after the low point 14, by a third sector, in which the cross-section progression 13 of the transverse groove 12 rises relatively rapidly again, and already reaches the original outside diameter of the rotor 3 again after about 27% of the width of the cell chamber 10 along the imaginary outside rotor diameter.

As has already been explained, the progression of the original outside diameter of the rotor 3 is then maintained as a second bearing crosspiece 11, in this exemplary embodiment over a region of the cell chamber 10 of approximately 5%, along the original outside diameter of the rotor 3, all the way to the bearing groove 4.

By means of this non-symmetrical configuration of the cross-section progression 13 of the transverse groove 12, according to the invention, low-friction and optimal, complete filling, in terms of flow technology, of the pump chambers is always achieved in vane cell pumps, in surprising manner.

In particular, by means of the solution according to the invention, it is possible to guarantee optimal, complete filling of the cell chambers 10 as well as optimal, fast, and low-friction emptying of the cell chambers 10, even at the speeds of rotation that were very critical until now, in the range of 4500 rpm to actually beyond 6000 rpm, without problems.

In this connection, the transverse grooves 12 according to the invention can furthermore also be produced in simple manner, in terms of production technology.

The vane cell pumps having the non-symmetrical transverse grooves according to the invention are also characterized, in this connection, as compared to the designs of the state of the art, by low-noise running even at very high speeds of rotation.

As has already been explained, it was determined in the series of experiments conducted with the solution according to the invention that it was also possible to clearly reduce the wear of the vane cell pumps and to minimize the power losses, by means of the solution presented here.

In summary, it can furthermore be stated that a high specific conveyed volume stream with a high degree of efficiency, not only at low speeds of rotation but particularly also at high speeds of rotation, i.e. in the range of 4500 rpm to beyond 6000 rpm, can be guaranteed by means of the solution according to the invention, at great reliability and a long useful lifetime.

In the exemplary embodiment shown in FIG. 1, a guide ring 19 is fitted into the rotor 3, which ring lies against the face sides 16 of the vane plates 5 that "lie on the inside", which plates themselves in turn lie against the outer ring 6 with their face sides 16 that "lie on the outside".

It is characteristic, in this connection, that the vane plates 5 of the vane cell pump according to the invention are rounded off at their face sides 16.

In the present exemplary embodiment, the radius disposed on the face sides 16 of the vane plates 5 corresponds to half the distance between the face sides 16 of the vane plates 5.

In this way, not only is an optimal, low-friction and low-wear seal of the cell chamber at the outer ring 6 guaranteed, but also, at the same time, an optimal, low-friction and low-wear guidance on the guide ring 19 during the entire rotation of the shaft 2 is guaranteed.

It is also in accordance with the invention that lubrication pockets 18 are disposed in the walls 17 of the bearing grooves 4 of the vane plates 5 disposed in the rotor 3, which pockets clearly minimize the wear between the vane plates 5 and the bearing grooves 4.

The control pressure chamber 23 shown in connection with the solution according to the invention in FIG. 1 is sealed, on both sides, by a sealing strip 24, in each instance, whereby the sealing strips 24 are mounted, in displaceable manner, in guide chamber grooves 25 assigned to them, in each instance, to which pressure is applied by the control pressure of the gallery.

It is advantageous, in this connection, that resilient elements, for example, as shown in FIG. 1, leaf springs 27 are disposed in the guide chamber grooves 25 (underneath the sealing strips 24), which elements guarantee that the sealing strips 24 are pressed against the pump housing 1 even if the vane cell pump (the motor) is turned off/stopped.

According to the invention, the guide chamber grooves 25 are connected with the control pressure chamber 23 by way of connection channels 26, so that the control pressure of the gallery, which flows in by way of the in-flow opening 22, can be reliably applied to the grooves, and therefore a highly reliable and very secure seal of the control pressure chamber 23 by means of the sealing strips 24 is guaranteed, with minimal construction space, even under extreme conditions.

Reference Symbol List

1 pump housing
2 shaft
3 rotor
4 bearing grooves
5 vane plates
6 outer ring
7 setting valve
8 suction kidney
9 pressure kidney
10 cell chamber
11 bearing crosspiece
12 transverse grooves
13 cross-section progression
14 low point
15 cell chamber center axis
16 face side
17 wall
18 lubrication pocket
19 guide ring
20 setting lever
21 pressure spring
22 in-flow opening
23 control pressure chamber
24 sealing strip
25 guide chamber grooves
26 connection channel
27 leaf spring

The invention claimed is:

1. Vane cell pump having a rotor (3) mounted in a pump housing (1) and driven by a shaft (2), multiple vane plates (5) mounted in bearing grooves (4) of the rotor (3), and an outer ring (6) that surrounds the rotor (3) and the vane plates (5), having a suction kidney (8) disposed in the pump housing (1), and a pressure kidney (9) disposed in the pump housing (1) offset by 180° from the suction kidney, and transverse grooves (12) disposed at the lower edge of each cell chamber (10) in the cylinder mantle surface of the rotor (3) between the bearing grooves (4), running over the entire rotor width, disposed parallel to the bearing grooves (4) of the vane plates (5), spaced apart from the bearing grooves (4) by a bearing crosspiece (11), wherein the transverse grooves (12) have a non-symmetrical cross-section progression (13), which has a low point (14), having the smallest radius of the rotor (3), in each of the cell chambers (10), wherein the low point is always disposed behind the cell chamber center axis (15), seen in the direction of rotation.

2. The vane cell pump according to claim 1, wherein the low point (14) lies below an imaginary outside diameter of the rotor (3) that connects the bearing crosspieces (11) with one another, by between 1% to 8% of the outside diameter.

3. The vane cell pump according to claim 1, wherein the vane plates (5) comprise a first side face (16) lying against the outer ring (6) and a second side face (16) opposite to the first side face, and wherein the first side face (16) and the second side face are rounded off.

4. The vane cell pump according to claim 3, wherein the vane plates (5) are provided with radii at the first and second side faces (16).

5. The vane cell pump according to claim 4, wherein the radii disposed at the first and second side faces (16) of the vane plates (5) correspond to half the distance between the first and second side faces (16).

6. The vane cell pump according to claim 1, wherein lubrication pockets (18) are disposed in walls (17) of the bearing grooves (4) of the vane plates (5) disposed in the rotor (3).

7. The vane cell pump according to claim 1, wherein the outer ring (6) is disposed in a setting valve (7) that is mounted so as to rotate and provided with a setting lever (20), whereby a pressure spring (21) mounted in the pump housing (1) lies against the setting lever (20) on one side, and a control pressure chamber (23) to which the control pressure of a gallery is applied by way of an in-flow opening (22) is disposed on the opposite side of the setting lever (20).

8. The vane cell pump according to claim 7, wherein the control pressure chamber (23) is sealed on both sides by a respective sealing strip (24), each of the respective sealing strips are mounted in a displaceable manner and in guide chamber grooves (25) assigned to the respective sealing strip where pressure is applied.

9. The vane cell pump according to claim 8, wherein the guide chamber grooves (25) are connected with the control pressure chamber (23) by way of connection channels (26).

10. The vane cell pump according to claim 8, wherein leaf springs (27) are disposed in the guide chamber grooves (25), underneath each of the respective sealing strips (24).

* * * * *